US008127700B2

(12) United States Patent
Ishii

(10) Patent No.: US 8,127,700 B2
(45) Date of Patent: Mar. 6, 2012

(54) SEWING MACHINE

(75) Inventor: Yasunori Ishii, Chofu (JP)

(73) Assignee: Juki Corporation, Chofu-shi, Tokyo (JP)

( * ) Notice: Subject to any disclaimer, the term of this patent is extended or adjusted under 35 U.S.C. 154(b) by 353 days.

(21) Appl. No.: 12/568,331

(22) Filed: Sep. 28, 2009

(65) Prior Publication Data

US 2010/0077950 A1 Apr. 1, 2010

(30) Foreign Application Priority Data

Sep. 29, 2008 (JP) ..... P.2008-251468

(51) Int. Cl.
*D05B 3/06* (2006.01)

(52) U.S. Cl. ..... 112/446

(58) Field of Classification Search ..... 112/445, 112/456, 458, 453, 457, 235, 470.01, 470.07, 112/475.25, 475.15, 446, 447
See application file for complete search history.

(56) References Cited

FOREIGN PATENT DOCUMENTS

| | | |
|---|---|---|
| JP | 5-49773 | 3/1993 |
| JP | 7-284587 | 10/1995 |
| JP | 10-66794 | 3/1998 |
| JP | 10-66796 | 3/1998 |

*Primary Examiner* — Tejash Patel
(74) *Attorney, Agent, or Firm* — Drinker Biddle & Reath LLP

(57) ABSTRACT

A sewing machine is provided. The sewing machine includes a needle, a feed dog which feeds a workpiece in a feeding direction, a stitching motor which vertically moves the needle, a needle swinging motor which swings the needle in a direction orthogonal to the feeding direction, a memory in which basic coordinate data of basic buttonhole stitches having a basic stitching width is stored, an input device from which a stitching width is input, and a control device which creates a modified coordinate data based on the basic coordinate data and the stitching width input from the input device, and controls the stitching motor and the needle swinging motor based on the modified coordinate data to form buttonhole stitches having the stitching width input from the input device.

4 Claims, 10 Drawing Sheets

SEWING MACHINE

CROSS-REFERENCE TO RELATED APPLICATIONS

This application claims priority under 35 U.S.C. §119 to Japanese Patent Application No. 2008-251468, filed on Sep. 29, 2008, which is incorporated by reference herein in its entirety.

FIELD OF THE INVENTION

The present invention relates to a sewing machine which can form buttonhole stitches.

BACKGROUND OF THE INVENTION

In related art sewing machines, when forming buttonhole stitches, a buttonhole stitching pattern is selected from a plurality of stitching pattern (see, e.g., JP 5-049773 A and JP 7-284587 A).

In related art sewing machines, stitching data for a plurality of stitching widths are prestored in a memory of a control device so that a stitching width can be selected in accordance with a shape or a size of a button, or a use of a workpiece. When a user inputs a desired stitching width, it is possible to read stitching data that corresponds to the input stitching width from the memory, and a buttonhole stitching is carried out based on the stitching data read from the memory.

However, in the related art sewing machines, a plurality of sets of stitching data corresponding to the number of widths that can be stitched are prepared and stored in the memory in advance. Therefore, a size of the stitching data to be stored in the memory is enormous so that a memory having a large capacity is required. Thus, a cost increase is unavoidable. On the other hand, when a capacity of the memory is reduced, the number of sets of stitching data that can be stored also reduces. Thus, it is difficult to flexibly meet user's needs.

SUMMARY OF THE INVENTION

In an embodiment, the invention provides a sewing machine. The sewing machine includes a needle bar having a lower end to which a needle is attached, a feed dog which feeds a workpiece in a feeding direction, a stitching motor which vertically moves the needle bar and moves the feed dog to carry out a feeding operation, a needle swinging motor which swings the needle in a direction orthogonal to the feeding direction, storing means for storing stitching data for a buttonhole stitching and coordinate data of inner and outer stitch points in left and right side stitching sections of buttonhole stitches having a basic overall stitching width, control means for controlling the stitching motor and the needle swinging motor to form buttonhole stitches, based on the stitching data stored in the storing means, stitching width input means for inputting an overall stitching width of buttonhole stitches, ratio calculating means for calculating a ratio of the overall stitching width, which is input from the stitching width input means, with respect to the basic overall stitching width, first position calculating means for multiplying the coordinate data of the outer stitch points in one of the side stitching sections of the buttonhole stitches having the basic overall stitching width by the ratio which is calculated by the ratio calculating means, thereby calculating coordinate data of outer stitch points in said one of the side stitching sections, side stitching width calculating means for calculating a side stitching width of said one of the side stitching sections from a difference in an overall stitching width direction component between the coordinate data of the outer stitch points in said one of the side stitching sections, which are calculated by the first position calculating means, and the coordinate data of the inner stitch points in said one of the side stitching sections of the buttonhole stitches having the basic overall stitching width, and second position calculating means for adding the coordinate data of the overall stitching width direction component corresponding to the side stitching width, which is calculated by the side stitching width calculating means, to the coordinate data of the inner stitch points in the other side stitching section of the buttonhole stitches having the basic overall stitching width, thereby calculating coordinate data of outer stitch points in said other side stitching section. The control means controls the stitching motor and the needle swinging motor, based on the coordinate data of the inner stitch points in both of the side stitching sections which are stored in the storing means, the coordinate data of the outer stitch points in said one of the side stitching sections which are calculated by the first position calculating means, and the coordinate data of the outer stitch points in the other side stitching section which are calculated by the second position calculating means.

In another embodiment, the invention provides a sewing machine. The sewing machine includes a needle, a feed dog which feeds a workpiece in a feeding direction, a stitching motor which vertically moves the needle, a needle swinging motor which swings the needle in a direction orthogonal to the feeding direction, a memory in which basic coordinate data of basic buttonhole stitches having a basic stitching width is stored, an input device from which a stitching width is input, and a control device which creates a modified coordinate data based on the basic coordinate data and the stitching width input from the input device, and controls the stitching motor and the needle swinging motor based on the modified coordinate data to form buttonhole stitches having the stitching width input from the input device.

In yet another embodiment, the invention provides a sewing machine. The sewing machine includes a needle, a feed dog which feeds a workpiece in a feeding direction, a stitching motor which vertically moves the needle, a needle swinging motor which swings the needle in a direction orthogonal to the feeding direction, a memory in which basic coordinate data of basic buttonhole stitches having a basic overall stitching width is stored, an input device from which an overall stitching width is input, and a control device which creates a modified coordinate data based on the basic coordinate data and the overall stitching width input from the input device, and controls the stitching motor and the needle swinging motor based on the modified coordinate data to form buttonhole stitches having the overall stitching width input from the input device.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF PREFERRED EMBODIMENTS

Figure 1:
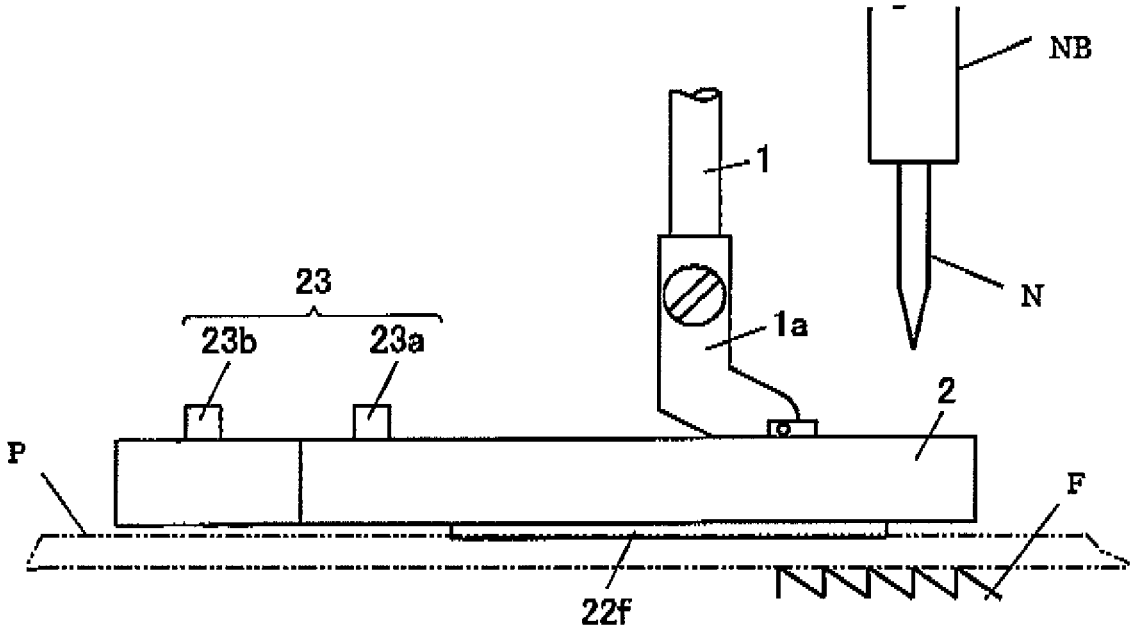
FIG. 1 is a schematic side view of a buttonhole stitching device.

Hereinafter, preferred embodiments of the invention will be described in detail with reference to the drawings.

Overall Configuration of Sewing Machine

A sewing machine according to an embodiment of the invention is a hole stitching machine. As shown in FIGS. 1 to 6, a hole stitching machine 10 includes a needle vertically moving mechanism which vertically moves a needle N by using a stitching motor 44 (see FIG. 6) as a driving source, a needle swinging mechanism which swings the needle N in a direction orthogonal to a cloth feeding direction, a feeding mechanism having a feed dog which moves in the cloth feeding direction to feed a cloth (a workpiece) and a presser frame in the cloth feeding direction and a feeding step motor 48 (see FIG. 6) serving as a feeding motor which regulates an amount of cloth to be fed by the feed dog, a buttonhole stitching device 2 which holds the cloth and feeds the cloth back and forth along the cloth feeding direction in cooperation with the feeding mechanism, and a control device 3 (see FIG. 6) which controls an operation of each of the components.

Needle Vertically Moving Mechanism and Needle Swinging Mechanism

The needle vertically moving mechanism includes an upper shaft (not shown) to be rotated and driven by the stitching motor 44, a power transmitting mechanism (not shown) using a cam or a crank for converting a rotating and driving force of the upper shaft into a reciprocal driving force of a vertical motion, thereby applying the reciprocal driving force to a needle bar NB holding the needle N, and a holding frame for holding the needle bar NB vertically movably. Moreover, a needle swinging step motor 46 (see FIG. 6) serving as a needle swinging motor is coupled to the needle bar NB of the needle vertically moving mechanism. The needle swinging step motor 46 serves to move the needle bar NB holding the needle N through the holding frame in a needle swinging direction which is orthogonal to the cloth feeding direction. That is, a needle swinging mechanism includes the needle bar NB and the needle swinging step motor 46.

Feeding Mechanism

The feeding mechanism includes a lower shaft (not shown) to be rotated and driven by the stitching motor 44 and a well-known transmitting mechanism for applying a reciprocal rotating force in the cloth feeding direction and a vertical direction from the lower shaft to the feed dog (not shown) by utilizing the cam or the crank. The transmitting mechanism can change and regulate a reciprocal operating amount and a phase in the cloth feeding direction by using a moving member such as a quadric link mechanism having a well-known structure or a square piece capable of varying a reciprocal operating direction, for example. The changing and regulating operation is carried out by using, as a driving source, the feeding step motor 48 to be the feeding motor.

Buttonhole Stitching Device

As shown in FIG. 1, a presser bar 1 pressed downward by means of a spring is supported on a jaw part at a tip of an arm portion of a frame of the hole stitching machine 10 vertically movably by a presser lever. A presser holder 1*a* is provided on a lower end of the presser bar 1. The presser holder 1*a* is provided with the buttonhole stitching device 2 for pressing a cloth.

The buttonhole stitching device 2 has a lower surface disposed opposite to an upper surface of a throat plate on which the cloth is to be mounted.

Figure 2:
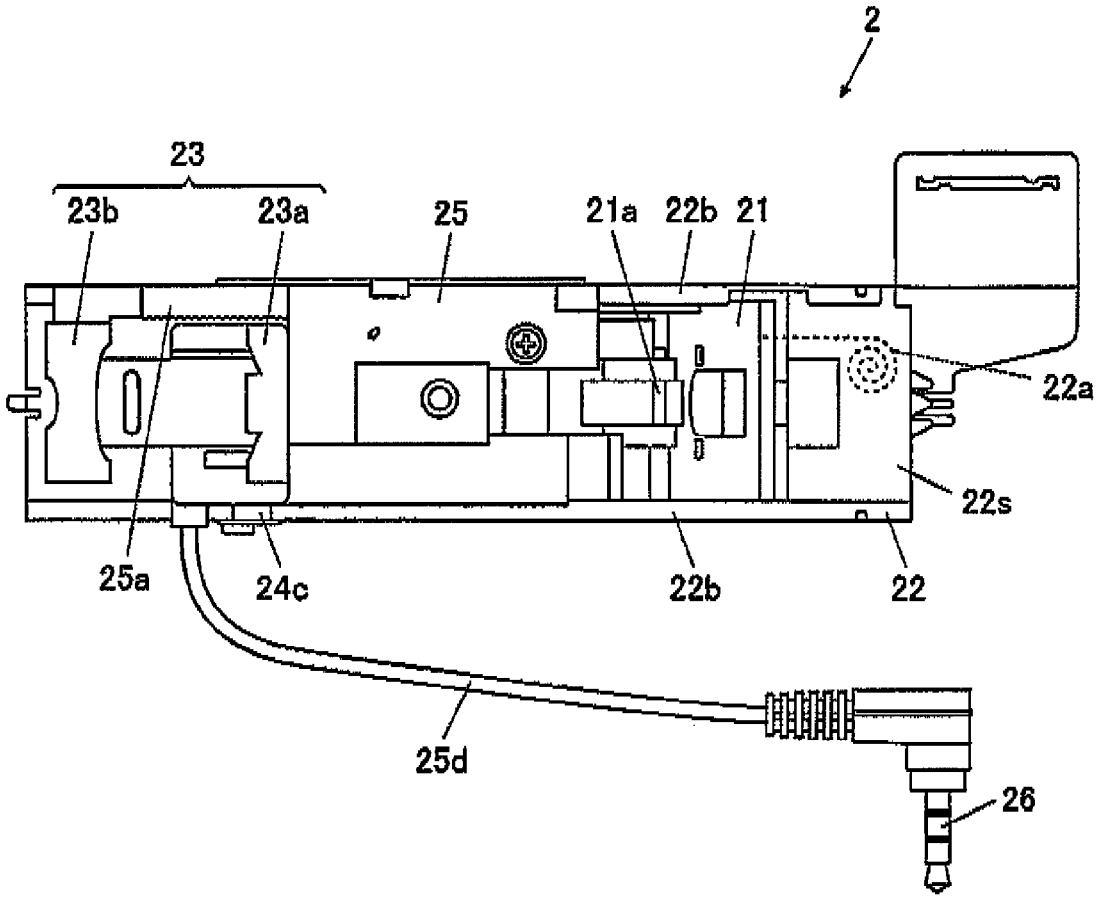
FIG. 2 is a plan view of the buttonhole stitching device.

As shown in FIG. 2, the buttonhole stitching device 2 includes a presser body 21 attached to the presser holder 1*a* provided on the lower end of the presser bar 1, a presser frame 22 held on the presser body 21 slidably and serving to press the cloth from above and to press the cloth while carrying out a movement with a cloth feeding work during a stitching operation, a button holder 23 provided integrally with the presser body 21, a position detector 24 (see FIG. 5) for detecting a displacement from a stitching start position in a buttonhole stitching at any time, and a button diameter detector 25 (see FIG. 4) for detecting a diameter of a button held by the button holder 23.

Presser Body

As shown in FIG. 2, an upper surface of the presser body 21 is provided with a coupling bar 21*a* for causing the presser holder 1*a* provided on the lower end of the presser bar 1 to hold and couple the presser body 21, and the presser holder 1*a* is provided with a holding portion capable of switching the hold and release of the coupling bar 21*a* by a manual operation. Accordingly, the presser body 21 can be detachably attached to the presser bar 1 by the hold and release of the coupling bar 21*a* through the presser holder 1*a*.

The presser body 21 is coupled to a spiral spring 22*a* provided on one of ends of the presser frame 22. The presser body 21 is energized to abut on a stopper 22*s* provided on one of the ends of the presser frame 22 until a force is applied from an outside to move the presser frame 22. A direction in which the spiral spring 22*a* pulls the presser body 21 toward the stopper 22*s* side is set to be a forward feeding direction in the cloth feeding operation and a direction in which the presser body 21 is pulled away from the stopper 22*s* against the spiral spring 22*a* is set to be a reverse feeding direction in the cloth feeding operation.

Presser Frame

As shown in FIG. 2, the presser frame 22 is formed by an almost rectangular plate member having a longitudinal direction along the cloth feeding direction, and a guide 22*b* for fitting the presser body 21 therein is formed in the longitudinal direction to slide with respect to the presser body 21. An opening for carrying out a buttonhole stitching is formed on the presser frame 22. The spiral spring 22*a* for energizing the stopper 22*s* of the presser frame 22 toward the presser body 21 is provided in the stopper 22*s* disposed on one of the ends of the presser frame 22. By the spiral spring 22*a*, the stopper 22*s* provided in the presser frame 22 is brought into an abutting state on the presser body 21 before a stitching start.

Position Detector

Figure 4:
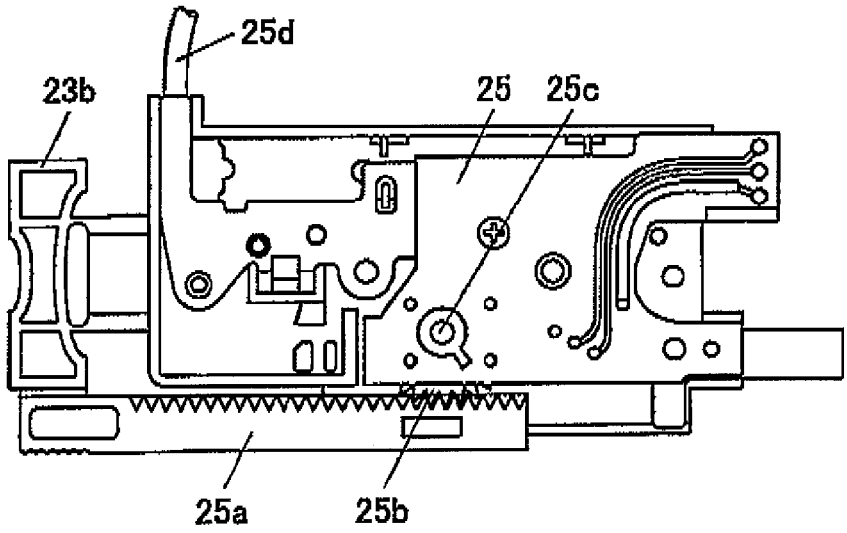
FIG. 4 is a plan view of a button diameter detector.
Figure 5:
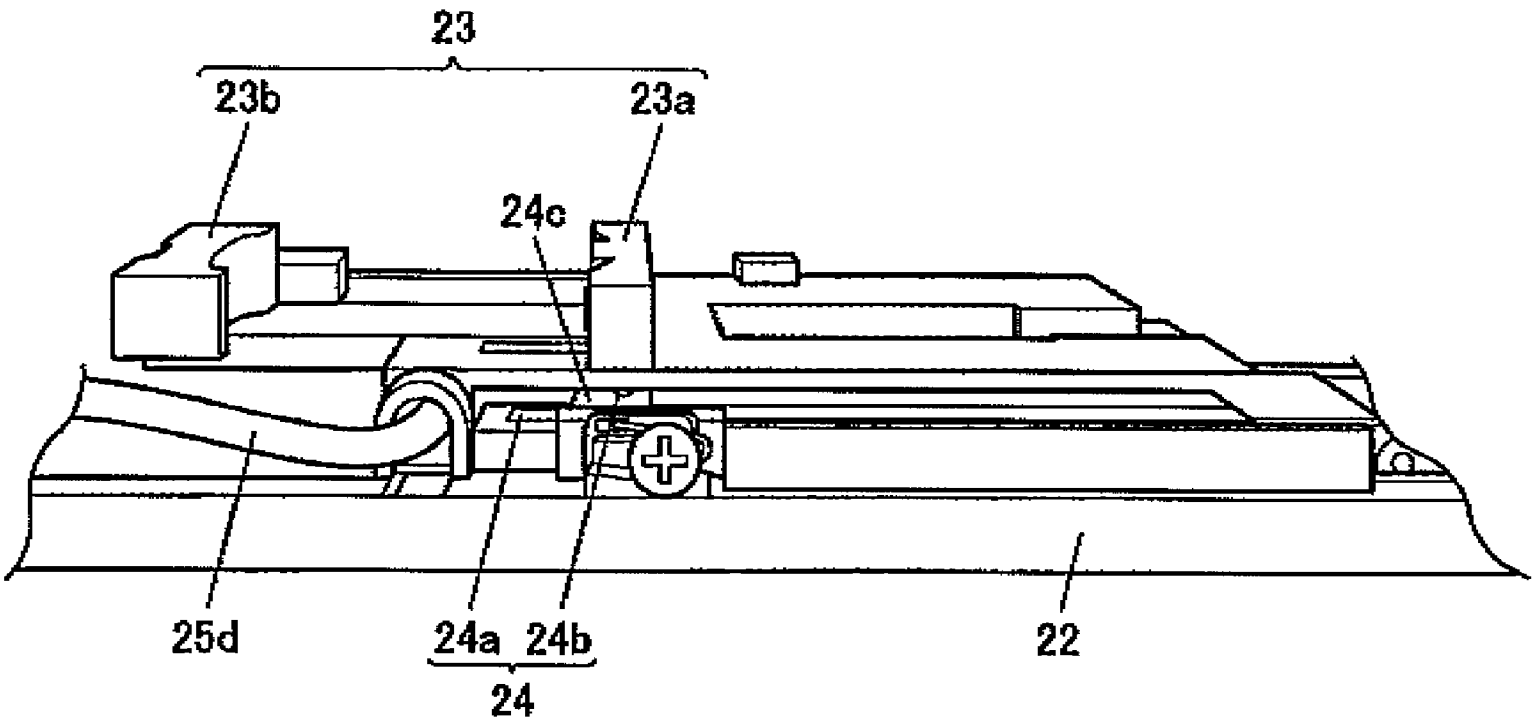
FIG. 5 is a perspective view of a periphery of a position detector.

As shown in FIGS. 2, 4 and 5, the position detector 24 serves to detect a feeding amount (a displacement) in the cloth feeding direction of the presser frame 22 with respect to the presser body 21.

The position detector 24 includes a slide potentiometer. The position detector 24 includes a variable resistor 24*a* fixed to the upper surface of the presser body 21 and extended in the cloth feeding direction and a volume lever 24*b* provided slidably in the cloth feeding direction above the variable resistor 24*a*.

The variable resistor 24*a* is provided in almost parallel with the longitudinal direction of the presser frame 22, that is, the cloth feeding direction. A resistance value of the variable resistor 24*a* is varied depending on a position of the volume lever 24*b* provided above the variable resistor 24*a*.

The volume lever 24*b* is held by a holding member 24*c* attached to the presser frame 22 such that both sides in a moving direction thereof are held. The presser body 21 is fixed to the presser bar 1. Therefore, the presser frame 22 is moved in the cloth feeding direction so that the holding member 24*c* is also moved in the cloth feeding direction. Consequently, the volume lever 24*b* held on the holding member 24*c* is also moved over the variable resistor 24*a* in the cloth feeding direction. Accordingly, the resistance value of the variable resistor 24*a* is changed depending on the feeding amount of the presser frame 22 so that a voltage value to be detected is varied. The presser frame 22 is moved depending on a feeding operation for a stitching work. By utilizing the movement, it is possible to measure a position in the cloth feeding direction of the presser frame 22, that is, a total length of buttonhole stitches that has been formed based on the voltage value which is detected.

The voltage value applied to the variable resistor 24*a* can be detected by the control device 3. The control device 3 can detect, at any time, the position in the cloth feeding direction of the presser frame 22 in a state in which the presser frame 22 is set into a stitching start position with respect to the pressing member 21, that is, a state in which one of the ends of the presser frame 22 abuts on the presser body 21.

Button Holder

Figure 3:
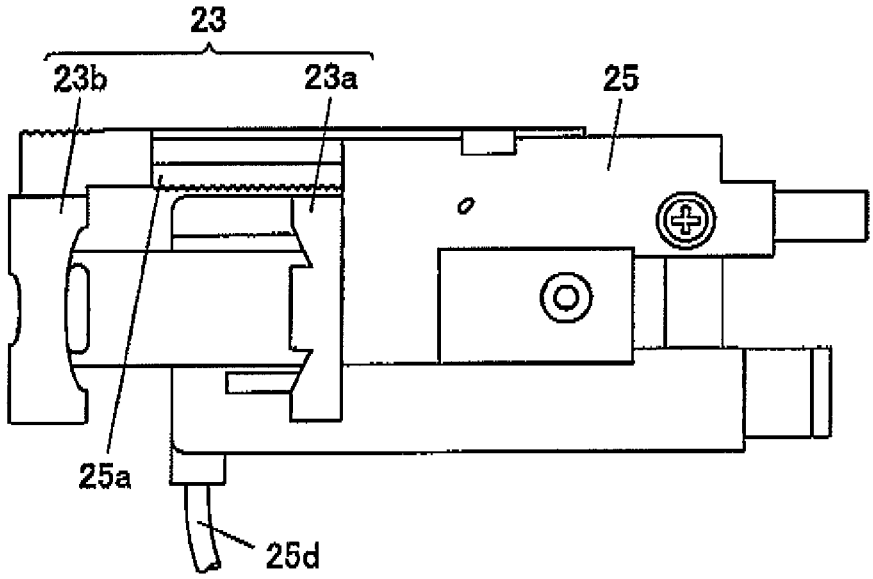
FIG. 3 is a plan view of a button holder.

As shown in FIGS. 2 and 3, the button holder 23 includes a fixed portion 23*a* fixed above the presser body 21 and the position detector 24 and serving to hold a part of an outer circumference of a button, and a sliding portion 23*b* disposed opposite to the fixed portion 23*a* and provided on the presser body 21 to enable an adjustment of a movement, and serving to hold a button together with the fixed portion 23*a*. The fixed portion 23*a* and the sliding portion 28*b* serve to hold both ends of a diameter of the button therebetween. Although the sliding portion 23*b* is movable with respect to the presser body 21 and the fixed portion 23*a*, it is configured such that the sliding portion 23*b* is stopped at a certain position unless an external force is applied. By moving the sliding portion 23*b* corresponding to a size of the button, it is possible to hold the button in a stable state.

Button Diameter Detector

As shown in FIGS. 3 and 4, the button diameter detector 25 includes a rack 25*a* fixed and provided on the sliding portion 23*b* of the button holder 23, a pinion 25*b* to be engaged with the rack 25*a*, a potentiometer 25*c* supported on the presser body 21, and a lead wire 25*d* for sending a signal output from the potentiometer 25*c* to the control device 3.

The pinion 25*b* is provided on a rotating amount detecting shaft of the potentiometer 25*c*. When the sliding portion 23*b* is moved in the cloth feeding direction depending on the size of the button to be held, the rack 25*a* fixed to the sliding portion 23*b* is also moved in the same direction. The movement rotates the pinion 25*b*. Therefore, the rotating amount detecting shaft of the potentiometer 25*c* is rotated so that a detection signal corresponding to a moving amount of the sliding portion 23*b* can be output to the control device 3.

The lead wire 25*d* serves to output, to the control device 3, a voltage value signal detected by the variable resistor 24*a* and the signal output from the potentiometer 25*c*, and has a tip provided with a connector 25 which is detachably attached to the control device 3.

Control Device

Figure 6:
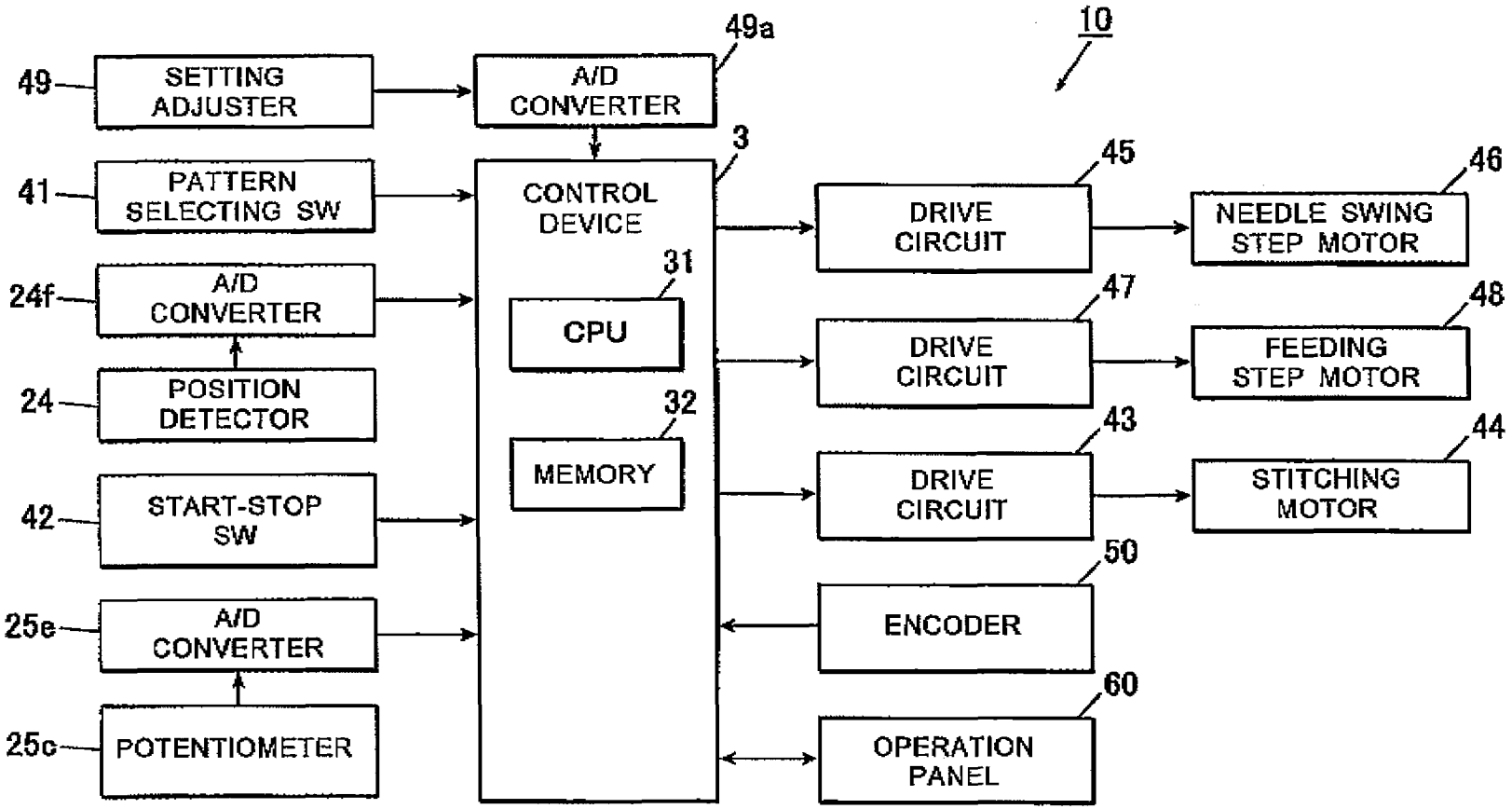
FIG. 6 is a block diagram of a control system of a hole stitching machine.

As shown in FIG. 6, the hole stitching machine 10 is provided with the control device 3 for controlling driving operations of the stitching motor 44, the needle swinging step motor 46 and the feeding step motor 48 in accordance with a stitching program.

A pattern selecting switch 41 for selecting and inputting a stitching pattern to be formed on a cloth, and a start-stop switch 42 for inputting a stitching start and stop, are connected to the control device 3. Moreover, a setting adjuster 49 for inputting a feeding pitch and a needle swinging width in a stitching work respectively is connected to the control device 3 though an A/D converter 49*a*. The pattern selecting switch 41 is provided on a surface of a body of the hole stitching machine 10, and includes a touch panel of an operation panel 60 serving as a display portion in which an operating instruction is input by a user. The start-stop switch 42 and the setting adjuster 49 are provided on the surface of the body of the hole stitching machine 10. The operation panel 60 may include a liquid crystal display panel to inform the user of various information about the hole stitching machine 10 under control of the control device 3. In the case in which the operation panel 60 is used for selecting a pattern, a plurality of stitching patterns is displayed on a screen thereof and the user touches the screen from above any of the stitching patterns which is desired so that the stitching pattern thus touched is selected and input and the information thus selected and input is transmitted to the control device 3. Furthermore, a button diameter detected by the button diameter detector 25 is displayed on the operation panel 60. In addition, the operation panel 60 is configured such that an overall stitching width Y of buttonhole stitches can be input therefrom (see FIG. 7). That is, the operation panel 60 functions as stitching width input means.

A stitching motor drive circuit 43 is connected to the control device 3, and the stitching motor 44 is connected to the stitching motor drive circuit 43.

An encoder 50 for detecting a shaft angle of the upper shaft to be rotated and driven by the stitching motor 44 is connected to the control device 3.

A needle swinging step motor drive circuit 45 is connected to the control device 3, and the needle swinging step motor 46 is connected to the needle swinging step motor drive circuit 45.

A feeding step motor drive circuit 47 is connected to the control device 3, and the feeding step motor 48 is connected to the feeding step motor drive circuit 47.

The potentiometer 25*c* is connected to the control device 3 through an A/D converter 25*e*, and a detecting output of the potentiometer 25*c* is input to the control device 3.

The position detector 24 is connected to the control device 3 through an A/D converter 24*f*, and a voltage which is detected and is applied to the variable resistor 24*a* is input as a detecting output to the control device 3.

The control device 3 includes a CPU 31 for executing a stitching program to control a driving operation of each portion, and a memory 32 in which stitching programs and stitching data related to stitching patterns (a bar tack, buttonhole stitches, etc.) are stored.

Stitching data for a buttonhole stitching is stored in the memory 32. That is, the memory 32 functions as storing means.

Figure 7:
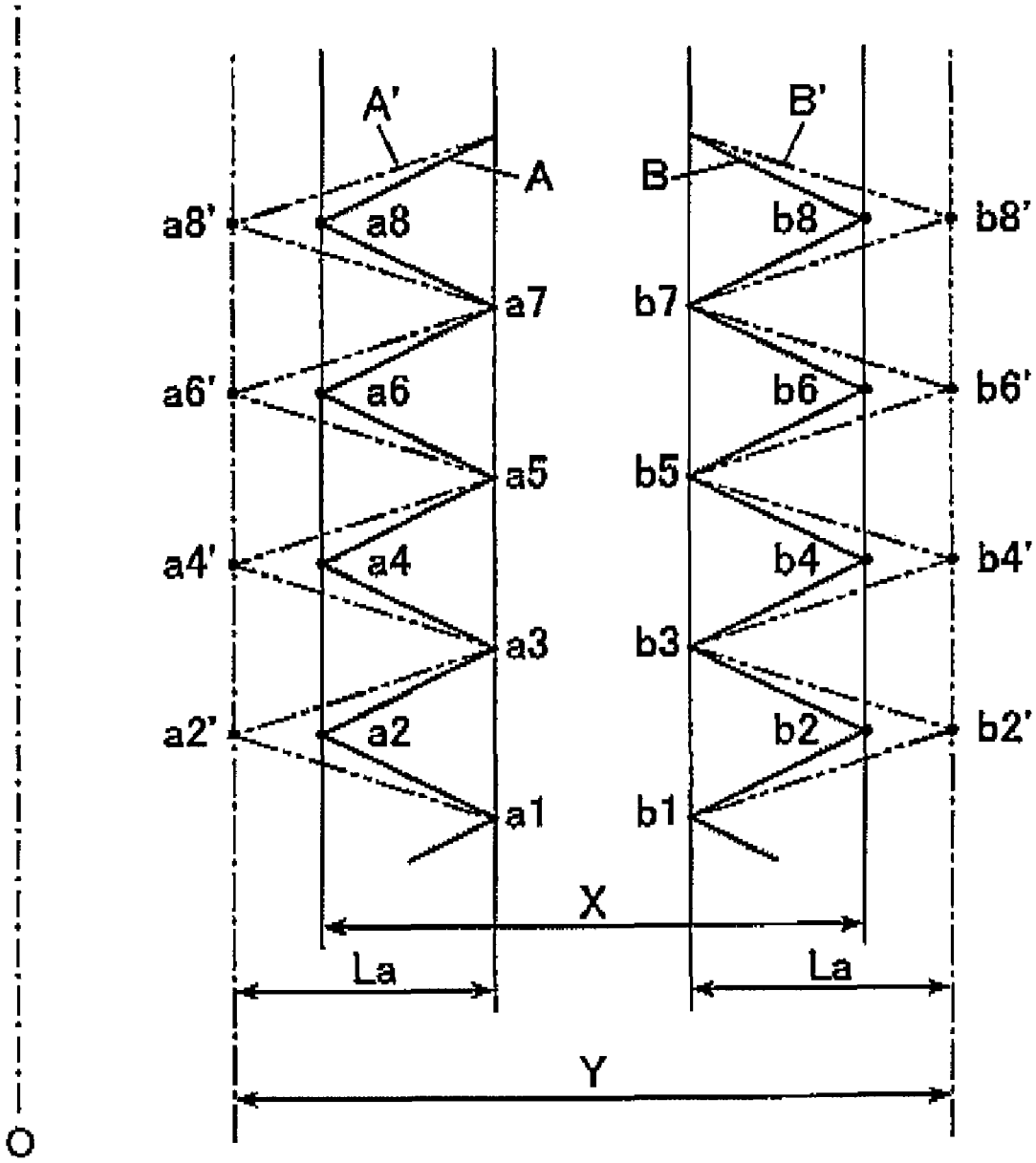
FIG. 7 is a diagram illustrating a change in a stitching width.

More specifically, the memory 32 stores coordinate data of inner and outer stitch points in left and right side stitching sections of buttonhole stitches having a basic overall stitching width X. As shown in FIG. 7, coordinate data of inner stitch points in a left side stitching section A are a1, a3, a5, . . . , and coordinate data of outer stitch points in the left side stitching section A are a2, a4, a6, . . . . Moreover, coordinate data of inner stitch points in a right side stitching section 13 are b1, b3, b5, . . . , and coordinate data of outer stitch points in the right side stitching section B are b2, b4, b6, . . . . Stitching is carried out at an inner stitch point and an outer stitch point alternately. That is, stitching is carried out in order of a1, a2, a3, a4, a5, a6, . . . in the left side stitching section A, and in order of b1, b2, b3, b4, b5, b6 . . . in the right side stitching section B. The coordinates of the respective stitch points are set such that buttonhole stitches to be formed have the basic overall stitching width X.

A ratio calculating program is stored in the memory 32. When the CPU 31 executes the ratio calculating program, the CPU 31 calculates a ratio r of an overall stitching width Y input from the operation panel 60 with respect to the basic overall stitching width X. That is, when the CPU 31 executes the ratio calculating program, the control device 3 functions as ratio calculating means.

The ratio r may be calculated as r=X/Y wherein X is the basic overall stitching width and Y is the overall stitching width input from the operation panel 60.

A first position calculating program is stored in the memory 32. When the CPU 31 executes the first position calculating program, as shown in FIG. 7, the CPU 31 multiplies the coordinate data a2, a4, a6, . . . of the outer stitch points in one of the side stitching sections (e.g., the left side stitching section A in this example) of buttonhole stitches having the basic overall stitching width X by the ratio r, which is calculated be executing the ratio calculating program, thereby calculating coordinate data a2', a4', a6', . . . , of outer stitch points in a left side stitching section A'. That is, when the CPU 31 executes the first position calculating program, the control device 3 functions as first position calculating means.

When the CPU 31 executes the first position calculating program, the CPU 31 multiplies an overall stitching width direction component of each of the coordinate data by r. For example, if the overall stitching width X of the basic buttonhole stitches is 4 mm and the overall stitching width Y input from the operation panel 60 is 5 mm, the ratio r=4/5. Here, the origin point in the overall stitching width direction is on the line O. Further, if the coordinate data (a coordinate value) of the outer stitch points a2, a4, a6, a8 of in the left side stitching section of the basic buttonhole stitches is 5, the multiplication by r gives 4 as the coordinate data of the outer stitch points a2', a6', a8' in the left side stitching section A' having the overall stitching width of 5 mm, whereby the overall stitching width is 1.25 times widened from X to Y. Thus, the outer position of both of the side stitching sections becomes outwardly farther from the buttonhole which is formed between the side stitching sections.

A side stitching width calculating program is stored in the memory 32. When the CPU 31 executes the side stitching width calculating program, the CPU 31 calculates a side stitching width La of the left side stitching section A' from a difference in the overall stitching width direction component between the coordinate data of the outer stitch points a2', a4', a6', a8' in the left side stitching section A, which is calculated by executing the first position calculating program, and the coordinate data of the inner stitch points a1, a3, a5, a7 in the left side stitching section A of the buttonhole stitches having the basic overall stitching width X. That is, when the CPU 31 executes the side stitching width calculating program, the control device 3 functions as side stitching width calculating means.

For example, if the coordinate data of the inner stitch points a1, a3, a5, a7 in the left side stitching section A' (A) is 10 in the example given above, a difference from the calculated coordinate data 4 of the outer stitch points a2', a4', a6', a8' in the left side stitching section A', i.e. 10−4=6, is calculated as the side stitching width La in the left side stitching section A'.

A second position calculating program is stored in the memory 32. When the CPU 31 executes the second position calculating program, the CPU 31 adds coordinate data of an overall stitching width direction component corresponding to the side stitching width La, which is calculated by executing the side stitching width calculating program, to the coordinate data of the inner stitch points b1, b3, b5, b7 in the other (right) side stitching section B of the buttonhole stitches having the basic overall stitching width X, thereby calculating coordinate data of an outer stitch point in the right side stitching section B'. That is, when the CPU 31 executes the second position calculating program, the control device 3 functions as second position calculating means.

For example, if the coordinate data of the inner stitch points b1, b3, b5, b7 in the right side stitching section B is 12 in the example given above, the CPU 31 adds 6, which is the calculated side stitching width La, to 12 which is the coordinate data of the inner stitch points b1, b3, b5, b7, thereby calculating the coordinate data of the outer stitch points b6', b8' in the right side stitching section B' as 18.

A control program is stored in the memory 32. When the CPU 31 executes the control program, the CPU 31 calculates an overall stitching length so as to be slightly longer than a button diameter detected by the button diameter detector 25, and controls the driving operations of the needle vertically moving mechanism, the feeding mechanism and the needle swinging mechanism based on the stitching data so as to form the buttonhole stitches having the calculated overall stitching length. That is, when the CPU 31 executes the control program, the control device 3 functions as control means.

When the CPU 31 executes the control program, the CPU 31 controls the driving operations of the needle vertically moving mechanism, the feeding mechanism and the needle swinging mechanism, based on the coordinate data of the inner stitch points in both of the side stitching sections A, B which are stored in the memory 32, the coordinate data of the outer stitch points in the left side stitching section A' which are calculated by executing the first position calculating program, and the coordinate data of the outer stitch points in the other right side stitching section B' which are calculated by executing the second position calculating program.

Flow of Buttonhole Stitching

Next, a flow of buttonhole stitching will be described with reference to FIG. 8. In the following example, the buttonhole stitches are formed in order of the left side stitching section and the right side stitching section while performing a tacking therebetween.

Before the buttonhole stitching, a cloth is mounted on a bed of the hole stitching machine 10 and is held by the buttonhole stitching device 2.

After mounting the cloth on the bed, a button to be inserted through a buttonhole is placed and held between the fixed portion 23*a* and the sliding portion 23*b* of the button holder 23. Then, the buttonhole stitches are formed.

Figure 8:
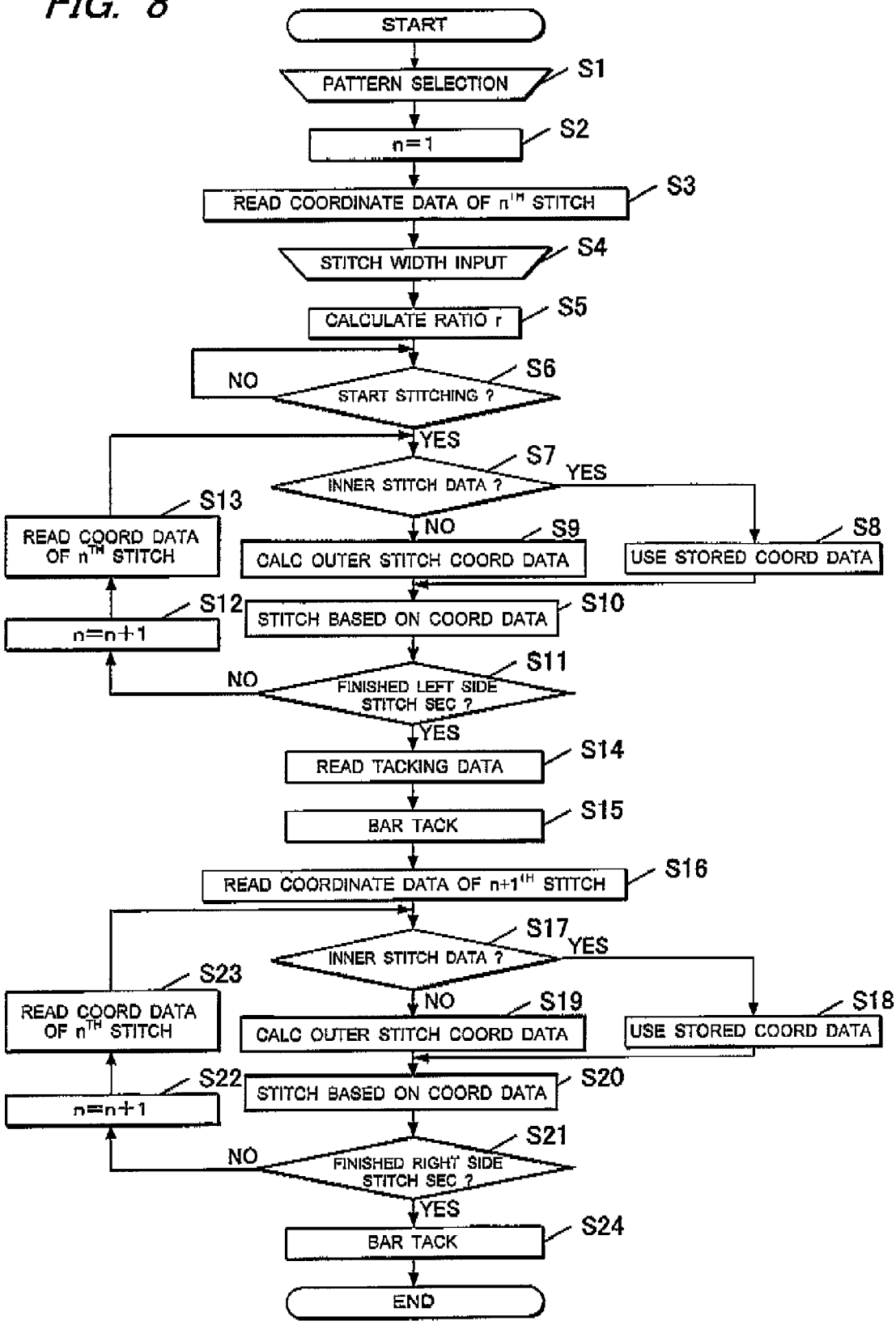
FIG. 8 is a flowchart of a buttonhole stitching.

As shown in FIG. 8, when a buttonhole stitching pattern is selected from the pattern selecting switch 41 (Step S1), the CPU 31 sets a stitch point number n in the left side stitching section as 1 (Step S2). Subsequently, stitching data of the selected buttonhole stitching pattern having a basic overall stitching width is read from the memory 32 (Step S3). Here, the stitching data to be read is coordinate data of a first stitch.

When an overall stitching width is input from the operation panel 60 after the selection of the pattern (Step S4), the CPU 31 executes the ratio calculating program to calculate the ratio r of the overall stitching widths (Step S5). When the ratio r is calculated, the CPU 31 determines whether the start-stop switch 42 is operated (Step S6).

If the CPU 31 determines that the start-stop switch 42 is operated (Step S6: YES), the CPU 31 then determines whether the coordinate data is an inner stitch point data of the side stitching section (Step S7).

If the CPU 31 determines that the coordinate data is the inner stitch point data (Step S7: YES), the CPU 31 uses the read coordinate data and controls the needle to stitch at the corresponding point (Steps S8 and S10).

If the CPU 31 determines that the coordinate data is not the inner stitch point data, i.e., is the coordinate data of the outer stitch point, (Step S7: NO), the CPU 31 executes the first position calculating program to calculate coordinate data of the outer stitch point corresponding to the input overall stitching width (Step S9). Then, the CPU 31 uses the calculated coordinate data and controls the needle to stitch at the corresponding point (Step S10).

During the stitching work, the CPU 31 determines whether the stitching operation for the left side stitching section is finished (Step S11).

If the CPU 31 determines that the stitching operation for the left side stitching section is not yet finished (Step S11: NO), the CPU 11 adds 1 to the stitch point number n (Step S12), and reads, from the memory 32, coordinate data of (n+1)th stitch point (Step S13). Thereafter, the flow returns to the Step S7.

If the CPU 31 determines that the stitching operation for the left side stitching section is finished (Step S11: YES), the CPU 31 reads tacking data from the memory 32 to carry out a tacking operation (Step S14). When the tacking operation is finished, the CPU 31 carries out a bar tacking operation corresponding to the number of stitches which is stored in the memory 32 (Step S15).

When the bar tacking operation is finished, the CPU 31 reads, from the memory 32, coordinate data of a stitch point having a stitch point number n+1 (Step S16), and determines whether the coordinate data is the inner stitch point data in the side stitching section (Step S17).

If the CPU 31 determines that the coordinate data is the inner stitch point data (Step S17: YES), the CPU 31 uses the read coordinate data and controls the needle to stitch at the corresponding point (Steps S18 and S20).

If the CPU 31 determines that the coordinate data is not the inner stitch point data, i.e. is the coordinate data of the outer stitch point, (Step S17: NO), the CPU 31 executes the side stitching width calculating program to calculate a side stitching width in the left side stitching section. Furthermore, the CPU 31 executes the second position calculating program to add the calculated coordinate data of an overall stitching width direction component to the coordinate data of the inner stitch point, thereby calculating coordinate data of the outer stitch point in the right side stitching section (Step S19).

Then, the CPU 31 uses the calculated coordinate data to control needle to stitch at the corresponding point (Step S20).

During the stitching work, the CPU 31 determines whether the stitching operation for the right side stitching section is finished (Step S21).

If the CPU 31 determines that the stitching operation for the right side stitching section is not yet finished (Step S21: NO), the CPU 31 adds 1 to the stitch point number n (Step S22), and reads, from the memory 32, coordinate data of (n+1)th stitch point (Step S23). Thereafter, the flow returns to the Step S17.

If the CPU 31 determines that the stitching operation for the right side stitching section is finished (Step S21: YES), the CPU 31 carries out the bar tacking operation corresponding to the number of stitches which is stored in the memory 32 (Step S24), and the flow is ended.

According to the hole stitching machine 10 having the configuration described above, when a desired overall stitching width of buttonhole stitches is input from the operation panel 60, the CPU 31 executes the ratio calculating program to calculate the ratio of the input overall stitching width to the basic overall stitching width.

Next, the CPU 31 executes the first position calculating program to multiply, by the ratio, the coordinate data of the outer stitch point in the left side stitching section of the buttonhole stitches having the basic overall stitching width, thereby calculating the coordinate data of the outer stitch point in the left side stitching section.

Then, the CPU 31 executes the side stitching width calculating program to calculate the side stitching width of the left side stitching section from the difference in the overall stitching width direction component between the calculated coordinate data of the outer stitch point in the left side stitching section and the coordinate data of the inner stitch point in the left side stitching section of the buttonhole stitches having the basic overall stitching width.

Thereafter, the CPU 31 executes the second position calculating program to add the coordinate data of the overall stitching width direction component corresponding to the calculated side stitching width to the coordinate data of the inner stitch point in the right side stitching section of the buttonhole stitches having the basic overall stitching width, thereby calculating the coordinate data of the outer stitch point in the right side stitching section.

Subsequently, the CPU 31 executes the control program to control the driving operations of the needle vertically moving mechanism, the feeding mechanism and the needle swinging mechanism, based on the coordinate data of the inner stitch points in the left and right side stitching sections which are stored in the memory 32, the coordinate data of the outer stitch point in the left side stitching section which are calculated, and the coordinate data of the outer stitch point in the right side stitching section which are calculated, whereby the buttonhole stitching is carried out.

Consequently, it is possible to widen or to narrow the coordinate data of the stitch points of the basic buttonhole stitches in the stitching width direction in accordance with the overall stitching width input from the operation panel 60. As a result, it is possible to create stitching data having different overall stitching width from a single set of stitching data of the basic buttonhole stitches. In other words, because a plurality of stitching data is obtainable from the single set of basic stitching data, it is not necessary to prepare stitching data for various stitching widths in advance.

Accordingly, it is possible to reduce a size of the stitching data without reducing the number of options for the stitching width of the buttonhole stitches.

First Modification

Next, a first modification will be described. In the first modification, an eyelet buttonhole stitching is carried out.

In addition to coordinate data of inner and outer stitch points in left and right side stitching sections of an eyelet buttonhole stitches having a basic overall stitching width, coordinate data of stitch points in a round stitching section of the eyelet buttonhole stitches corresponding to a plurality of overall stitching widths are stored in the memory 32.

Figure 9:
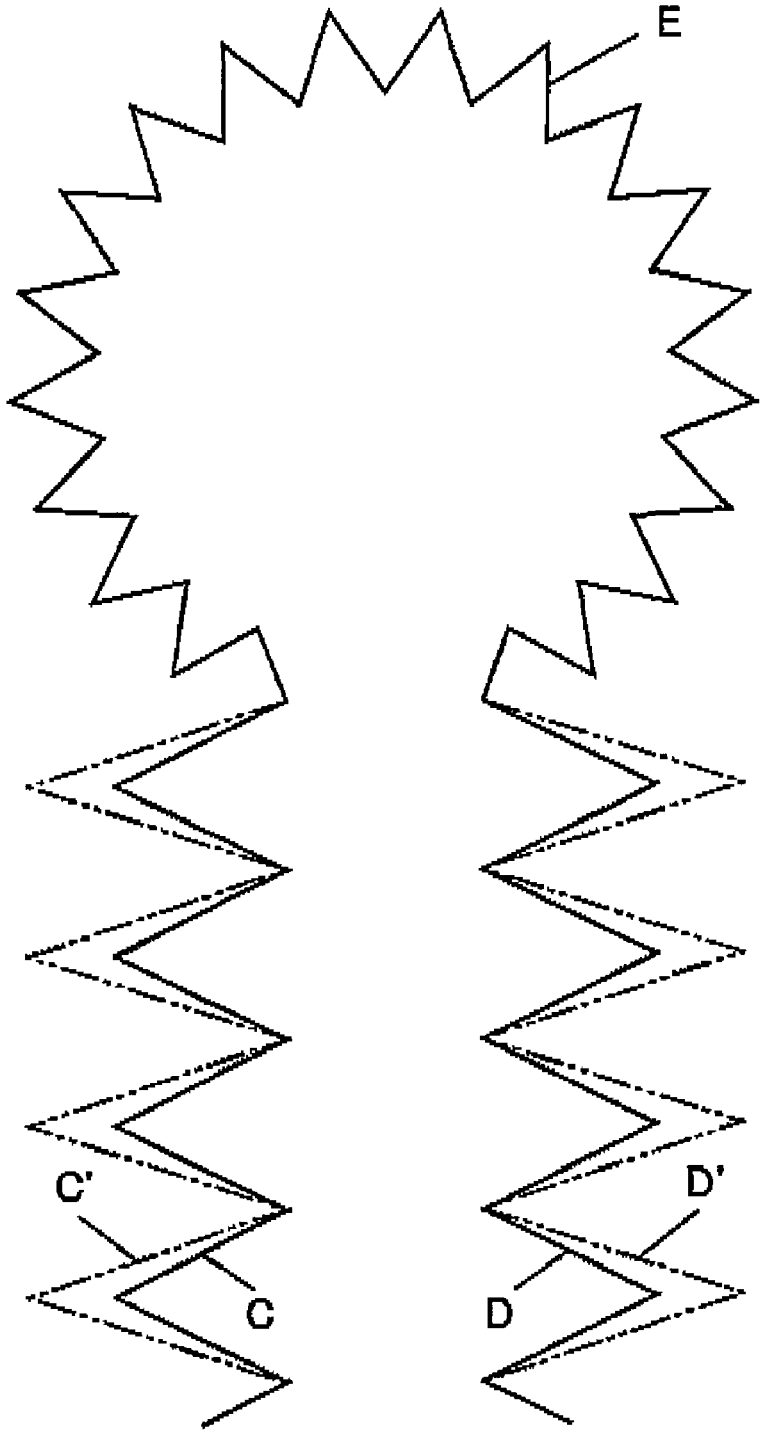
FIG. 9 is a diagram illustrating a change in a stitching width according to a first modification.

As shown in FIG. 9, when the CPU 31 executes a control program stored in the memory 32, as for the left and right side stitching sections C' and D' of the eyelet buttonhole stitches, the CPU 31 controls the driving operations of the needle vertically moving mechanism, the feeding mechanism and the needle swinging mechanism based on the coordinate data of inner stitch points in both of the side stitching sections C and D which are stored in the memory 32, coordinate data of outer stitch points in the left side stitching section C' which are calculated by executing the first position calculating program, and coordinate data of outer stitch points in the right side stitching section D' which are calculated by executing the second position calculating program. That is, the coordinate data of the left and right side stitching sections C' and D' are calculated in a similar manner as in the embodiment described above, and the left and right side stitching sections C' and D' are formed based on the calculated coordinate data.

When the CPU 31 executes the control program, as for a round stitching section. E, the CPU 31 controls the driving operations of the needle vertically moving mechanism, the feeding mechanism and the needle swinging mechanism, based on the coordinate data of stitch points corresponding to the overall stitching width input from an operation panel 60. That is, as for the round stitching section E, the coordinate data are prestored in the memory 32 for various overall stitching widths, and when the left side stitching section C' is formed, the CPU 31 carries out a stitching work of the round stitching section E by using the coordinate data of the round stitching section E that corresponds to the overall stitching width input from the operation panel 60. Then, the CPU 31 carries out a stitching work in the right side stitching section D' when the round stitching section E is formed, and finally performs a bar tacking operation.

Flow of Eyelet Buttonhole Stitching

Next, description will be given to a flow of the eyelet buttonhole stitching. The same processes as those in the embodiment described above is denoted by the same step numbers and description thereof will be omitted.

When the stitching work in the left side stitching section C is finished in accordance with the same procedure as that in the embodiment described above (Steps S1 to S11 in FIG. 8), the CPU 31 reads the coordinate data of the stitch points in the round stitching section E from the memory 32. Then, the CPU 31 controls the needle to stitch based on the read coordinate data to form the round stitching section E. When the stitching work in the round stitching section E is finished, the CPU 31 reads the coordinate data of the stitch points in the right side stitching section D.

Subsequently, a stitching work in the right side stitching section D' is carried out in accordance with the same procedure as that in the embodiment described above (Steps S17 to S24 in FIG. 8), whereby the flow is ended.

That is, a plurality of stitching data are obtained from the single basic stitching data, and stitching data for a plurality of overall stitching widths are prepared in advance for the round stitching section E.

Accordingly, also in case of the eyelet buttonhole stitching, it is possible to reduce the size of the stitching data for the left and right side stitching sections.

Second Modification

Next, a second modification will be described. In the second modification, an eyelet buttonhole stitching is also carried out. However, differently from the first modification, and coordinate data of stitch points are calculated in accordance with the input overall stitching width also for the round stitching section.

Figure 10:
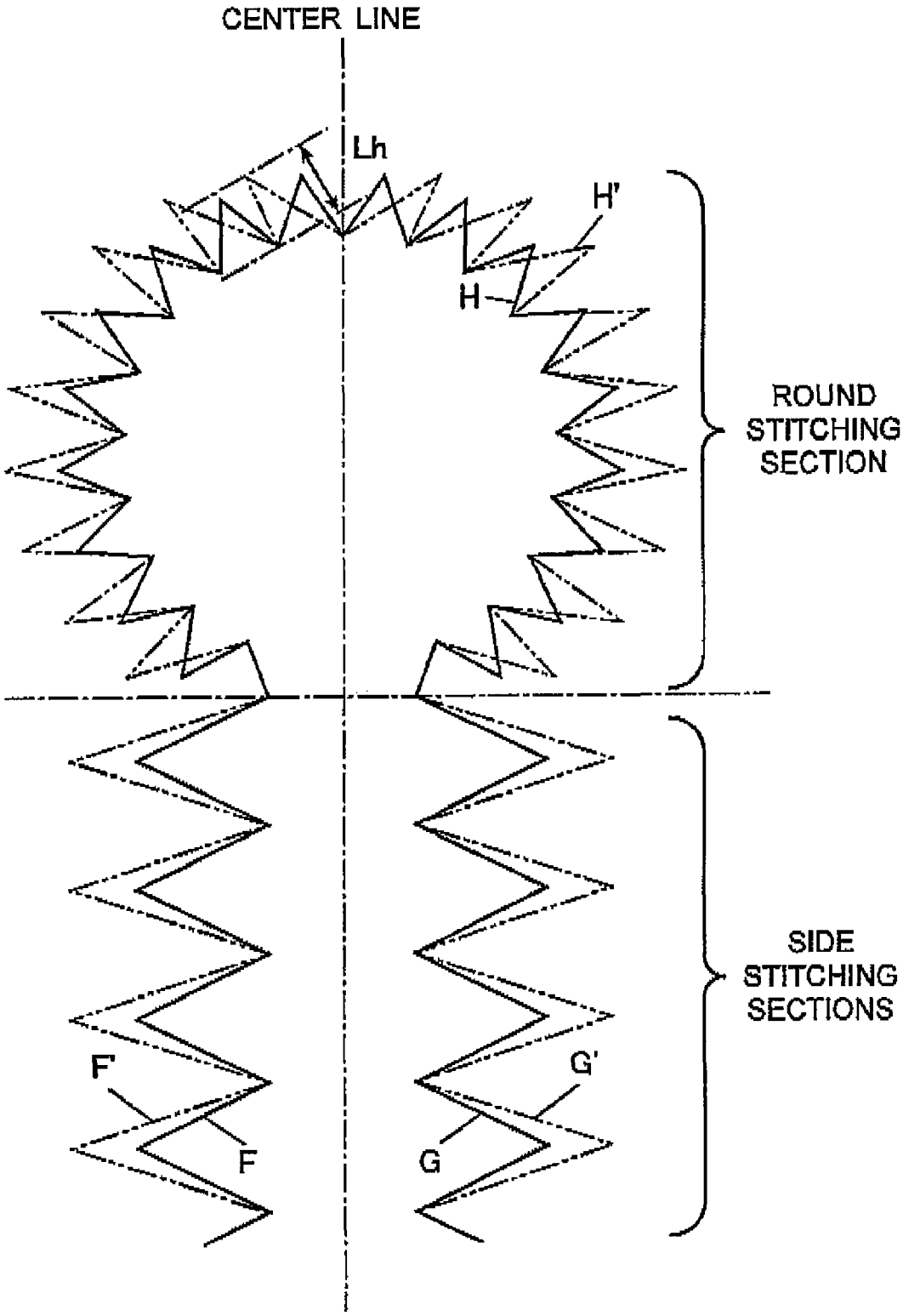
FIG. 10 is a diagram illustrating a change in a stitching width according to a second modification.

As shown in FIG. 10, in a memory 32, coordinate data of inner and outer stitch points in left and right side stitching sections F and G of eyelet buttonhole stitches having a basic overall stitching width and coordinate data of inner and outer stitch points in a round stitching section H of the eyelet buttonhole stitches having the basic overall stitching width, are stored. The inner stitch points in the round stitching section H are the stitch points on an inner circumferential side of the round stitching section H, and the outer stitch points in the round stitching section H are the stitch points on an outer circumferential side of the round stitching section H.

A third position calculating program is stored in the memory 32. When the CPU 31 executes third position calculating program, the CPU 31 multiplies the coordinate data of the outer stitch points in a one side portion (e.g., a left side portion in this example) of the round stitching section H of the eyelet buttonhole stitches having the basic overall stitching width, which is on one side from a center in an overall stitching width direction, by the calculated ratio of the overall stitching widths, thereby calculating coordinate data of outer stitch points in the one side portion of a round stitching section H'. That is, when the CPU 31 executes the third position calculating program, the control device 3 functions as third position calculating means.

A round stitching width calculating program is stored in the memory 32. When the CPU 31 executes the round stitching width calculating program, the CPU 31 calculates a round stitching width in the left side portion of the round stitching section H' from a difference in an overall stitching width direction component between the coordinate data of the outer stitch points in the left side portion of the round stitching section H' which are calculated by executing the third position calculating program and the coordinate data of the inner stitch points in the left side portion of the round stitching section H of the eyelet buttonhole stitches having the basic overall stitching width. That is, when the CPU 31 executes the round stitching width calculating program, the control device 3 functions as round stitching width calculating means.

A fourth position calculating program is stored in the memory 32. When the CPU 31 executes the fourth position calculating program, the CPU 31 adds coordinate data of an overall stitching width direction component corresponding to the round stitching width, which is calculated by executing the round stitching width calculating program, to the coordinate data of inner stitch points in the other side portion (a right side portion) of the round stitching section H in the eyelet buttonhole stitches having the basic overall stitching width, thereby calculating coordinate data of outer stitch points in the right side portion of the round stitching section H'. That is, when the CPU 31 executes the fourth position calculating program, the control device 3 functions as fourth position calculating means.

When the CPU 31 executes the control program, the CPU 31 controls the driving operations of the needle vertically moving mechanism, the feeding mechanism and the needle swinging mechanism, based on the coordinate data of the inner stitch points in the round stitching section H which are stored in the memory 32, the coordinate data of the outer stitch points in the left side portion of the round stitching section H' which are calculated by executing the third position calculating program, and the coordinate data of the outer stitch points in the right side portion of the round stitching section H' which are calculated by executing the fourth position calculating program.

Flow of Eyelet Buttonhole Stitching

Figure 11:
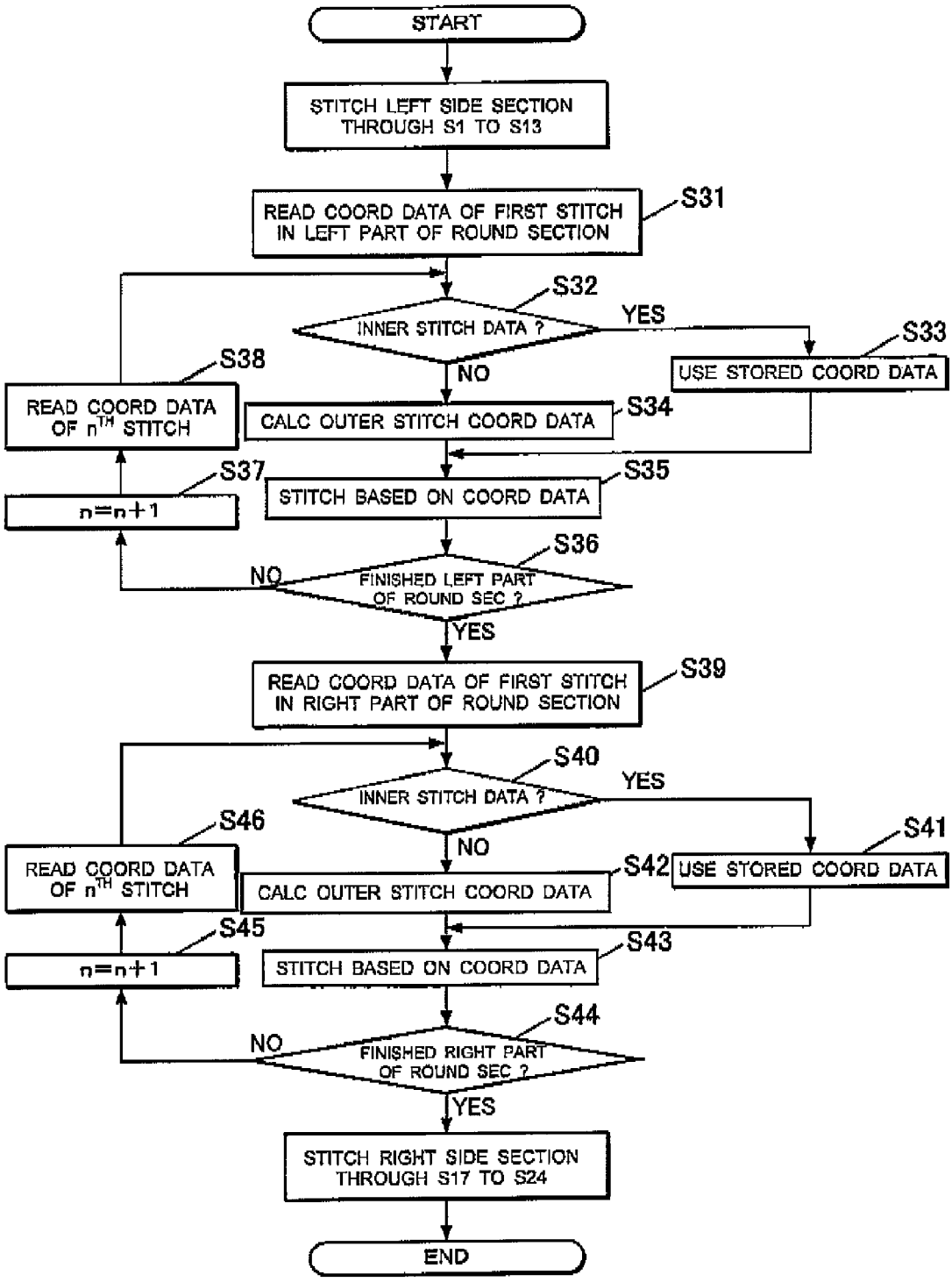
FIG. 11 is a flowchart of a round stitching according to the second modification.

Next, a flow of eyelet buttonhole stitching will be described with reference to FIG. 11. Processes that are the same as those in the embodiment described above are denoted by the same step numbers, and description thereof will be omitted. FIG. 11 describes primarily the steps for forming the round stitching section.

When a stitching work in the left side stitching section F' is finished in accordance with the same procedure as that in the embodiment described above (Steps S1 to S13 in FIG. 8), the CPU 31 reads, from the memory 32, the coordinate data of the stitch point of the round stitching section H on the left side from the center in the overall stitching width direction (Step S31). Next, the CPU 31 determines whether the coordinate data are inner stitch point data in the round stitching section H (Step S32).

As shown in FIG. 11, if the CPU 31 determines that the coordinate data are the inner stitch point data (Step S32: YES), the CPU 31 uses the read coordinate data to control needle to stitch at the corresponding point (Steps S33 and S35).

If the CPU 31 determines that the coordinate data are not the inner stitch point data, i.e. the coordinate data of the outer stitch point (Step S32: NO), the CPU 31 executes the third position calculating program to calculate the coordinate data of the outer stitch point that corresponds to the input overall stitching width (Step S34). Then, the CPU 31 uses the calculated coordinate data to control needle to stitch at the corresponding point (Step S35).

During the execution of the stitching work, the CPU 31 determines whether the stitching operation for the left side portion of the round stitching section is finished (Step S36).

If the CPU 31 determines that the stitching operation on the left side portion in the round stitching section H', which is on the left side from the center in the overall stitching width direction, is not yet finished (Step S3; NO), the CPU 31 adds 1 to the stitch point number n (Step S37), and reads, from the memory 32, the coordinate data of (n+1)th stitch point (Step S38). Thereafter, the flow returns to the Step S32.

If the CPU 31 determines that the stitching operation on the left side portion in the round stitching section H', which is on the left side from the center in the overall stitching width direction, is finished (Step S36: YES), the CPU 31 reads, from the memory 32, the coordinate data of the stitch point in the right side portion of the round stitching section H, which is on the right side from the center in the overall stitching width direction in (Step S39).

Next, the CPU 31 determines whether the coordinate data are inner stitch point data in the round stitching section H' (Step S40).

If the CPU 31 determines that the coordinate data are the inner stitch point data (Step S40: YES), the CPU 31 uses the read coordinate data to control needle to stitch at the corresponding point (Steps S41 and S43).

If the CPU 31 determines that the coordinate data not the inner stitch point data, i.e. the coordinate data of the outer stitch point (Step S40: NO), the CPU 31 executes the round stitching width calculating program to calculate a round stitching width Lh in the left side portion of the round stitching section H'. Further, the CPU 31 executes the fourth position calculating program to add the calculated coordinate data of an overall stitching width direction component to the read coordinate data of the inner stitch point in the right side portion of the round stitching section H', thereby calculating coordinate data of the outer stitch point in the right side portion of the round stitching section H' (Step S42).

Then, the CPU 31 uses the calculated coordinate data to control needle to stitch at the corresponding point (Step S43).

During the execution of the stitching work, the CPU 31 determines whether the stitching operation on the right side portion of the round stitching section is finished (Step S44).

If the CPU 31 determines that the stitching operation in the right side portion of the round stitching section H' is not yet finished (Step S44: NO), the CPU 31 adds 1 to the stitch point number n (Step S45), and reads, from the memory 32, coordinate data of (n+1)th stitch point (Step S46). Thereafter, the flow returns to the Step S40.

If the CPU 31 determines that the stitching operation in the right side portion of the round stitching section is finished (Step S44: YES), the CPU 31 carries out the stitching operation in the right side stitching section G' in accordance with the same procedure as that in the embodiment described above (Steps S17 to S24 in FIG. 8), whereby the flow is ended.

Also in the eyelet buttonhole stitches, consequently, it is possible to widen or to narrow the coordinate data of basic the stitch points in both the left and right side stitching sections and the round stitching section of the eyelet buttonhole stitches in the overall stitching width direction in accordance with the overall stitching width input from the operation panel 60. As a result, it is possible to create stitching data having different overall stitching width from a single set of stitching data of the basic buttonhole stitches. In other words, because a plurality of stitching data is obtainable from the single set of basic stitching data, it is not necessary to prepare stitching data for various stitching widths in advance.

Accordingly, it is possible to reduce a size of the stitching data without reducing the number of options for the stitching width of the buttonhole stitches.

While the invention has been disclosed with reference to certain preferred embodiments, numerous modifications, alterations, and changes to the described embodiments are possible without departing from the sphere and scope of the invention, as defined in the appended claims and their equivalents thereof.

For example, while the overall stitching length corresponding to the button diameter detected by the detector is calculated and the stitching operation is carried out within the calculated stitching length in the embodiment described above, the present invention is not restricted thereto. For example, it is also possible to carry out a control for detecting an overall stitching length corresponding to a button diameter while performing a feeding operation by means of a feed dog and then reversing a feeding direction automatically, thereby forming the overall stitching length corresponding to the button diameter.

Accordingly, it is intended that the invention not be limited to the described embodiments, but that it have the full scope defined by the language of the following claims.

What is claimed is:

1. A sewing machine comprising:

a needle bar having a lower end to which a needle is attached;

a feed clog which feeds a workpiece in a feeding direction;

a stitching motor which vertically moves the needle bar and moves the feed dog to carry out a feeding operation;

a needle swinging motor which swings the needle in a direction orthogonal to the feeding direction;

storing means for storing stitching data for a buttonhole stitching and coordinate data of inner and outer stitch points in left and right side stitching sections of buttonhole stitches having a basic overall stitching width;

control means for controlling the stitching motor and the needle swinging motor to form buttonhole stitches, based on the stitching data stored in the storing means;

stitching width input means for inputting an overall stitching width of buttonhole stitches;

ratio calculating means for calculating a ratio of the overall stitching width, which is input from the stitching width input means, with respect to the basic overall stitching width;

first position calculating means for multiplying the coordinate data of the outer stitch points in one of the side stitching sections of the buttonhole stitches having the basic overall stitching width by the ratio which is calculated by the ratio calculating means, thereby calculating coordinate data of outer stitch points in said one of the side stitching sections;

side stitching width calculating means for calculating a side stitching width of said one of the side stitching sections from a difference in an overall stitching width direction component between the coordinate data of the outer stitch points in said one of the side stitching sections, which are calculated by the first position calculating means, and the coordinate data of the inner stitch points in said one of the side stitching sections of the buttonhole stitches having the basic overall stitching width; and second position calculating means for adding the coordinate data of the overall stitching width direction component corresponding to the side stitching width, which is calculated by the side stitching width calculating means, to the coordinate data of the inner stitch points in the other side stitching section of the buttonhole stitches having the basic overall stitching width, thereby calculating coordinate data of outer stitch points in said other side stitching section, wherein the control means controls the stitching motor and the needle swinging motor, based on the coordinate data of the inner stitch points in both of the side stitching sections which are stored in the storing means, the coordinate data of the outer stitch points in said one of the side stitching sections which are calculated by the first position calculating means, and the coordinate data of the outer stitch points in the other side stitching section which are calculated by the second position calculating means.

2. The sewing machine according to claim 1, wherein the storing means stores coordinate data of inner and outer stitch points in left and right side stitching sections of an eyelet buttonhole stitches having a basic overall stitching width and coordinate data of stitch points in a round stitching section of eyelet buttonhole stitches corresponding to a plurality of overall stitching widths, the control means controls the stitching motor and the needle swinging motor to form the left and right side stitching sections, based on the coordinate data of the inner stitch points in both of the side stitching sections which are stored in the storing means, the coordinate data of the outer stitch points in said one of the side stitching sections which are calculated by the first position calculating means, and the coordinate data of the outer stitch points in the other side stitching section which are calculated by the second position calculating means, and the control means controls the stitching motor and the needle swinging motor to form the round stitching section, based on the coordinate data of stitch points in the round stitching section that corresponds to the overall stitching width input from the stitching width input means.

3. The sewing machine according to claim 1, wherein the storing means stores coordinate data of inner and outer stitch points in left and right side stitching sections of an eyelet buttonhole stitches having a basic overall stitching width and coordinate data of inner and outer stitch points in a round stitching section of the eyelet buttonhole stitches having the basic overall stitching width, wherein the sewing machine further comprises:

third position calculating means for multiplying the coordinate data of the outer stitch points in a one side portion of the round stitching section of the eyelet buttonhole stitches having the basic overall stitching width on one side from a center in an overall stitching width direction by the ratio calculated by the ratio calculating means, thereby calculating coordinate data of the outer stitch points in said one side portion of the round stitching section;

round stitching width calculating means for calculating a round stitching width in said one side portion of the round stitching section from a difference in an overall stitching width direction component between the coordinate data of the outer stitch points in said one side portion of the round stitching section which are calculated by the third position calculating means and the coordinate data of the inner stitch points in said one side portion of the round stitching section of the eyelet buttonhole stitches having the basic overall stitching width; and fourth position calculating means for adding coordinate data of an overall stitching width direction component corresponding to the round stitching width calculated by the round stitching width calculating means to the coordinate data of inner stitch points in the other side portion of the round stitching section of the eyelet buttonhole stitches having the basic overall stitching width, thereby calculating coordinate data of outer stitch points in the other side portion of the round stitching section, and the control means controls the stitching motor and the needle swinging motor, based on the coordinate data of the inner stitch points in the round stitching section which are stored in the storing means, the coordinate data of the outer stitch points in said one side portion the round stitching section which are calculated by the third position calculating means, and the coordinate data of the outer stitch point at the other side in the round stitching section which are calculated by the fourth position calculating means.

4. The sewing machine according to claim 1, further comprising a feeding motor which regulates a feeding amount of the feed dog;

a presser body which is detachably attached to a lower end of a presser bar;

a presser frame which is supported by the presser body so as to be movable in the feeding direction and to hold the workpiece;

a button holder having a fixed portion which holds a part of an outer circumference of a button, and a sliding portion which is disposed so as to face the fixed portion and to move toward and away from the fixed portion, wherein the button is held between the fixed portion and the sliding portion; and button diameter detecting means for detecting a diameter of the button from a distance between the fixed portion and the sliding portion, wherein the feed dog feeds the presser frame together with the workpiece in each stitch, and the control means controls the stitching motor, the feeding motor and the needle swinging motor so as to form the buttonhole stitches to have an overall stitching length that corresponds to the diameter detected by the button diameter detecting means.

* * * * *